United States Patent [19]

Godijn

[11] 3,958,762

[45] May 25, 1976

[54] GAS BURNER

[75] Inventor: Willem Godijn, Hilversum, Netherlands

[73] Assignee: Research Instituut Sesto B.V., Hilversum, Netherlands

[22] Filed: Oct. 15, 1974

[21] Appl. No.: 515,076

[30] Foreign Application Priority Data

Oct. 19, 1973 Netherlands ..... 7314389

[52] U.S. Cl. ..... 239/552; 239/568; 239/566; 239/555

[51] Int. Cl.[2] ..... B05B 1/14

[58] Field of Search ..... 239/552, 554, 555, 568, 239/566

[56] References Cited

UNITED STATES PATENTS

| | | | |
|---|---|---|---|
| 2,512,752 | 6/1950 | Simpson | 239/552 |
| 2,600,160 | 6/1952 | Flynn | 239/552 |
| 3,615,054 | 10/1971 | Botz | 239/555 |

FOREIGN PATENTS OR APPLICATIONS

| | | | |
|---|---|---|---|
| 1,037,897 | 5/1953 | France | 239/552 |

*Primary Examiner*—Carroll B. Dority, Jr.
*Attorney, Agent, or Firm*—Karl W. Flocks

[57] ABSTRACT

A gas burner with a nest of ribbons, the ribbons of which in at least one of the edge portions are provided with spacing means, said ribbons being collected such that in the nest of strips or ribbons one or more rows of gap-like main gas burner ports are formed between successive spacing means in which of the spacing means defining the main gas burner ports in the composite gas burner the spacing means facing the gas supply side are shifted by half a pitch relative to the spacing means facing the flame side.

8 Claims, 13 Drawing Figures

Figure 4:
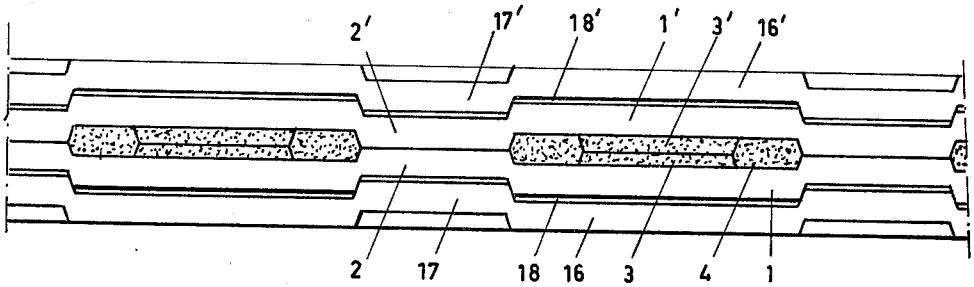

FIG. 1A
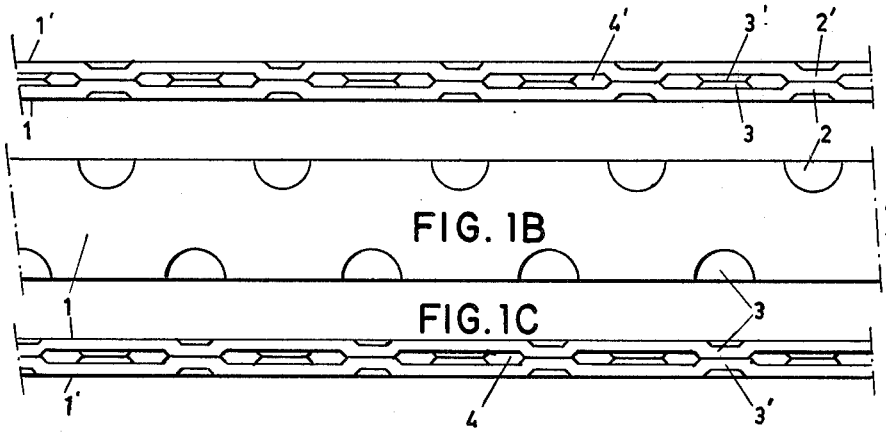
FIG. 1B
FIG. 1C
FIG. 1D
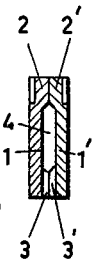
FIG. 2A
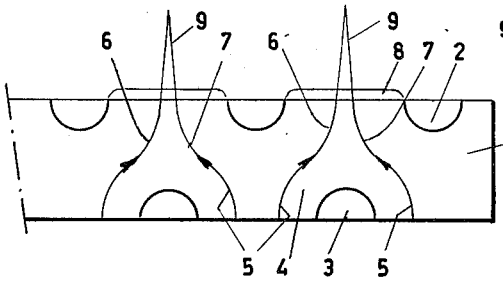
FIG. 2B
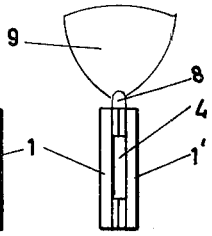
FIG. 3A
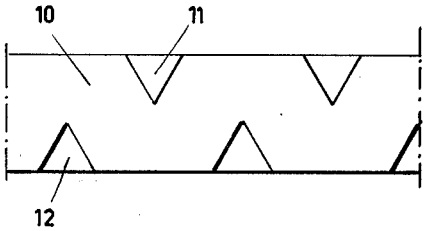
FIG. 3B
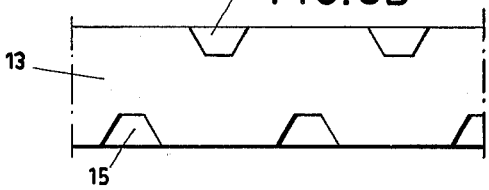

GAS BURNER

This invention relates to a gas burner comprising a mixing chamber with burner orifice, in which a removable burner bed is incorporated comprising a nest of ribbons, the ribbons of which in at least one of the edge portions are provided with spacing means, said ribbons being pressed against each other by wall faces of the burner orifice and being collected such that in the nest of ribbons one or more rows of gap-like main gas burner ports are formed between successive spacing means and one or more rows of auxiliary gas burner ports.

Such a gas burner is known from the Dutch Pat. No. 6,704,388. In this known gas burner the spacing means are provided in both edge portions and aligned in the direction of flow of the gas. Generally always two ribbons are arranged with the faces remote from the spacing means against one another, the spacing means obtained by deformation from one side being shifted relative to one another. The ribbons are collected in this manner to a nest of ribbons clamped in some known manner in the burner orifice so that after each pair of ribbons a row of gap-like main gas burner ports are formed. Against the side faces of the burner orifice ribbons may be arranged which comprise spacing means of less height so that consequently at the side edges of the burner orifice each time a row of auxiliary gas burner ports are obtained. It is also possible to use in the known gas burner ribbons comprising spacing means having a height equal to half the desired width of the main gas burner ports. When the ribbons are collected to a nest the spacing means of a pair of ribbons are then arranged against the spacing means of a next pair.

The Dutch patent application mentions as an advantage that on the main gas burner ports separate flame cores are formed. Between said flame cores transverse passages are formed allowing the supply of additional secondary air. Consequently a lower flame is produced resulting in a reduced risk of incomplete combustion and/or deposit of soot on the heat exchange means situated above the burner, and a lower pre-mixing may be applied so that a higher port load is possible. This renders possible a more compact design both of the burners and of the boilers in which said burners are used.

However, in this known gas burner still a pre-mixing of 80% is necessary. If the pre-mixing becomes less, then a incomplete combustion will be the result, because the supply of secondary air cannot compensate the reduced pre-mixing.

Now the invention aims at improving the supply of secondary air so that one may do with a very low pre-mixing and a still higher port load may be arrived at.

According to the invention this is accomplished in that of the spacing means defining the main gas burner ports in the composite gas burner the spacing means facing the gas supply side are shifted by half a pitch relative to the spacing means facing the flame side.

This special arrangement of the spacing means in the composite burner brings about a very surprising effect. At a very low capacity (low nozzle pressure) the flame is positioned in the normal way on the main gas burner port, i.e. approximately in the plane of the slot forming the main gas burner port. When the nozzle pressure is raised the flame starts to rotate and assumes a position perpendicular to the slot. When the nozzle pressure is still further increased the bat-shaped very low flame does not become higher but it becomes wider. Since said bat-shaped flames are spaced according to the pitch of the spacing means, therefore also of the main gas burner ports, a very satisfactory supply of secondary air is possible so that a very low pre-mixing of 10–20% may suffice.

The phenomenon may be explained as follows. At a very low nozzle pressure the flows of the gas-air mixture in the main gas burner ports are so weak that nowhere a thrust is produced and the gas mixture may flow out comparatively free and unimpeded. The flames then stand normally on the main gas burner ports. When the nozzle pressure is raised two gas flows being formed in the slots constituting the main gas burner ports an being directed obliquely upwards and towards each other will increasingly thrust against one another, and as soon as they have left the slot will only be able to expand in a direction perpendicular to the slot. This expansion starts slightly above the slot, as may be observed at the flame, where on the slot a core of 1-2 mm height and transversely to said core a bat-shaped flame is visible. As a result of these impinging flows of the gas-air mixture, which expand perpendicular to the slot, there is produced a thin but wide column of gas adapted to come into contact with secondary air over a large surface thus making possible a rapid and complete combustion resulting in a low flame. The content of non-combusted products and CO is then limited to zero or to only a few p.p.m. At a further increase of the nozzle pressure the two gas flows will only thrust more strongly against each other and will expand more perpendicularly to the slot so that a widening of the flame and no increase in height of the flame is obtained. The widening of the flame results in a larger contact surface with the secondary air and a complete combustion is maintained. An additional advantage or said widening of the flame instead of an increased height of the flame, as in the case of the known gas burner, is that the heat exchange means situated above the gas burner may be arranged closer to the flame without the risk of incomplete combustion and deposit of soot respectively.

As a result of the low pre-mixing which may be applied with the gas burner according to the invention the capacity of one row of slots or main gas burner ports in the burner according to the invention corresponds with a nest of ribbons of 6–8 rows of slots in the burner according to the cited Dutch patent application No. 6704388, the ribbon or burner bed length and slot dimensions being the same in both instances.

Although the shape of the spacing means may strongly vary it is preferred if the spacing means, viewed on the flat side of the ribbons are approximately semi-circular, the diameter of the semicircle being situated approximately at the level of the ribbon edge. Thus a satisfactory guiding of the gas flows is realized without considerable flow losses. In particular when the spacing means are obtained by deformation of the ribbons, this shape of the spacing means is advantageous from a point of view of manufacturing technique, because one may use nipples and apertures for the punches.

If the spacing means are obtained by deformation from one side and at each of the edges of the ribbons up to a thickness dimension equal to approximately half the width of the main gas burner ports, and said main gas burner ports are formed by two ribbons with their spacing means abutting against one another, it is of advantage if on one side or either side beside a row of main gas burner ports one or more rows of auxiliary gas burner ports are formed by arranging the ribbons with their spacing means in the recess of spacing means of the adjacemt ribbons.

Forming a nest of ribbons with more than two rows of main gas burner ports, said ports being arranged one beside the other, may badly influence the favourable effect. On the two outermost rows bat-shaped flames are skill formed, but on the main gas burner ports of the intermediate rows the flames stand again in alignment with the ports. It will, moreover, be possible for these flames to become higher by lack of secondary air which namely is consumed for the greater part by the outermost rows.

In case two rows of main gas burner ports are used, the slots may be arranged one beside the other so that consequently perpendicular to the pair of slots a bat-shaped flame, be it a somewhat wider one, is formed. It is preferred, however, if the main gas burner ports of a row of said ports are shifted by half a pitch relative to the main gas burner ports of an adjacent row, so that the bat-shaped flames of one row stand between those of the other row and a satifactory supply of secondary air to each row is maintained.

Of course it is also possible to arrange a nest of four rows of main gas burner ports beside one another such, that the slots are situated per pair one beside the other, but the slots of one pair being shifted by part of the pitch relative to the other pair.

Now in order to obtain yet a gas burner of large capacity the main gas burner ports can be arranged at a sufficient large mutual distance. For this purpose two nests of each time four rows of main gas burner ports may be placed against two opposite side walls of the burner orifice and the remaining intermediate space between said nests may be filled for example whith blind ribbons or a fitting block. However, it is difficult to get sufficient secondary air between the flames. This secondary air rises past the side walls of the burner bar vertically and must be deflected in the horizontal direction in order to get between the flames.

In order to remove said drawback a favourable embodiment of the gas burner comprises two burner orifices pointing aslant upwards and in opposite directions. To this end the burner bar may be somewhat modified. In each burner orifice there is then arranged a nest of ribbons for example with four rows of main gas burner ports. In this way the bat-shaped flames are brought into the vertical secondary air flows. An additional advantage is that in a horizontal plane above the burner the temperature is very much uniform.

In this embodiment it is surprising that the bat-shaped flames are standing on the main gas burner ports in such a stable manner that they do not show any tendency of bending their tops upwards.

In an other favourable embodiment of the gas burner according to the invention the latter is of a round design with horizontal and radial gas outlet, the ribbons being annular and flat with spacing means at the inner and or outer circumference shifted by half a pitch. In this embodiment the width dimension of the bat-shaped flames is vertical. In this embodiment the annular ribbons can be clamped between an upper and a lower burner chamber, the gas-air mixture being fed for example through a conduit to the lower gas burner chamber.

From the foregoing it is apparent that on account of the use of ribbons, both straight and annular ones, there is a great flexibility in the selection of the burner shape. The flames may at choice be directed vertically, horizontally and/or aslant. The burner and the flames can be entirely adapted to the shape and the location of the combustion chamber and of the heat exchange means so that always an optimal efficiency can be arrived at.

It is also of advantage that the flames in the burner according to the invention cannot flash back. Even when using a gas that easily flashes back the flames will not strike back. The reasons are as follows. As a result of the very low pre-mixing there flows through the main gas burner ports a gas-air mixture which is not or only little combustible since it is above the explosion limit. As the flame stands vertically on the ribbons the heating of the ribbons by radiation of the flame is small. The ribbons are cooled by the flows of secondary air between the flames. Finally the high rate of outflow the flows of gas prevents the flames from striking back.

Figure 5:
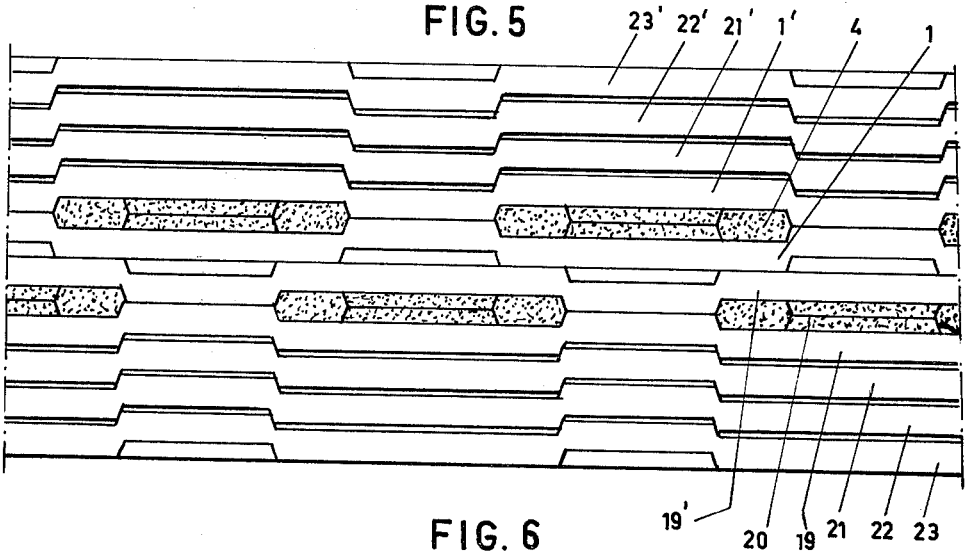
Figure 6:
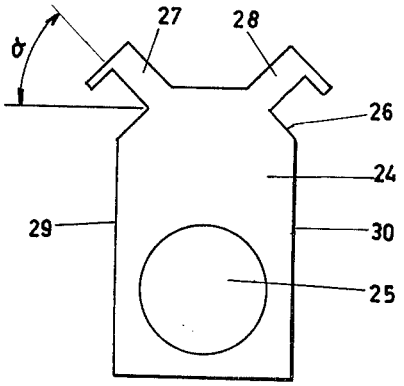
Figure 7A:
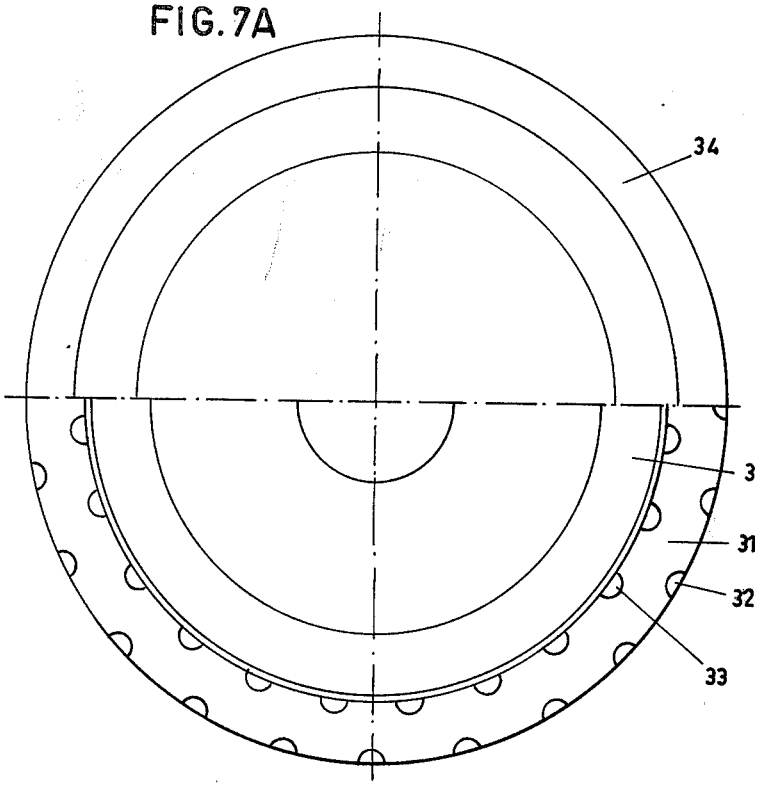
Figure 7B:
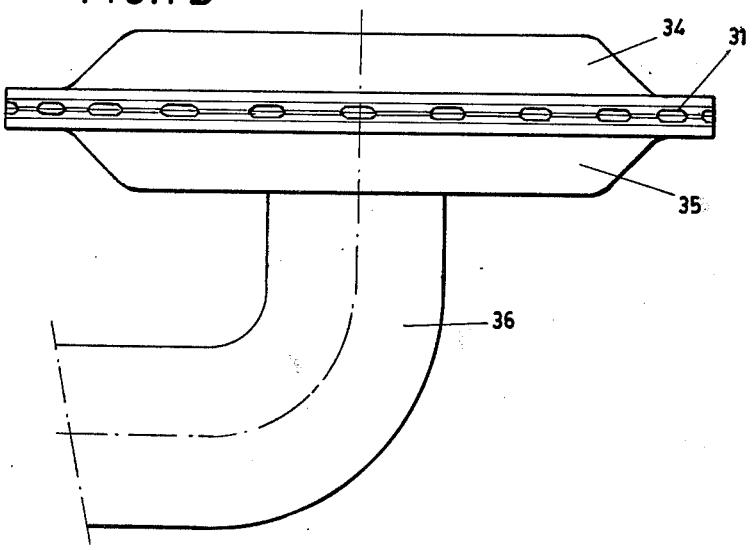

The invention is explained by means of the following description with reference to the drawings. Said drawings show in FIGS. 1A–1D various views of two abutting ribbons with spacing means applied in an embodiment of a gas burner according to the invention;

FIGS. 2A and 2B illustratively an explanation of the shape of the flame in front view and side view;

FIGS. 3A and 3B other forms of spacing means;

FIG. 4 a top plan view of an embodiment of a nest of ribbons;

FIG. 5 a top plan view of another embodiment of a nest of ribbons;

FIG. 6 the arrangement of two burner ports in a special embodiment of the gas burner according to the invention, and in FIGS. 7A and 7B two views and a partial section of the round embodiment of the gas burner according to the invention.

In the embodiment shown in FIGS. 1A–1D two ribbons 1 and 1' with spacing means 2, 2' and 3, 3' are placed against each other. In this instance said spacing means are formed by indentation from one side in the edge portions of the ribbons 1 and 1' and they have a half-round shape. The upper spacing means 2 of the ribbon 1 abut against the upper spacing means 2' of ribbon 1' while the lower spacing means 3 of ribbon 1 abut against the lower spacing means 3' of ribbon 1'. Now according to the invention the spacing means 2, 2' are staggered by half a pitch in longitudinal direction relative to the spacing means 3, 3'. The spacing means now form between the ribbons slots, called main gas burner ports 4, which, however, do not allow a straight passage of the gas flows.

In FIGS. 2A and 2B it is shown how the gas flows are guided through the main gas burner ports 4. A gas flow 5 supplied form one side of the main gas burner ports is split into two partial flows 6 and 7. The partial flow 6 thrusts, on passing through the main gas burner port 4, against the partial flow 7 of an adjacent gas flow 5. At the exit of the partial flows 6 and 7 thrust one against the other the gas expands mainly transversely to the opening of the main gas burner ports 4, a core 8 and a wide bat-shaped flame 9 being formed, at any rate if the nozzle pressure is sufficiently high.

Instead of a semi-round shape the spacing means on the ribbons may also be differently shaped. FIGS. 3A and 3B respectively show a ribbon 10 with triangular spacing means 11 and 12 and a ribbon 13 with trapezoid spacing means 14 and 15.

FIG. 4 shows a nest of ribbons comprising four strips 1, 1′ 16 and 16′. The ribbons 1 and 1′ are placed again with the corresponding spacing means 2, 2′ and 3, 3′ against each other so that between them main gas burner ports 4 are formed. On either side of these two ribbons 1 and 1′ there are arranged two ribbons 16 and 16′ such that the spacing means 17 and 17′ respectively are positioned in the indented back sides of the spacing means 2 and 2′ respectively of the ribbon 1 and 1′ respectively. Since the spacing means 17 and 17′ respectively cannot reach entirely to the bottom of the back sides of the spacing means 2 and 2′ respectively, there will be created between the flat portions of the ribbons 1 and 16 and the ribbons 1′ and 16′ respectively gaps 18 and 18′ respectively forming auxiliary burner ports.

In FIG. 5 there are arranged beside the pair of ribbons 1 and 1′ a second pair of ribbons 19 and 19′, collected in the same manner as the ribbons 1 and 1′, the ribbon 19′ abutting against ribbon 1 such that the main gas burner ports 4 and 20 are staggered by half a pitch relative to each other. As a result the bat-shaped flames from the main gas burner ports 20 get partly between the bat-shaped flames from the main gas burner ports 4. Beside the strips 19 and 1′ there are arranged again a number of ribbons 21–23 and 21′–23′ respectively such that a plurality of rows of auxiliary burner ports are created.

In a preferred embodiment of gas burners having a great capacity, as shown in FIG. 6, two burner orifices 27 and 28 are pointing aslant upwards and in opposite directions and are arranged according to an angle relative to the horizontal plane on the burner pipe 24 with gas supply 25. In a technical embodiment the burner pipe 24 may comprise slanting faces 26 on which the burner orifices 27 and 28 can be arranged. As a result of this arrangement of the burner orifices 27 and 28 secondary air rising along the walls 29 and 30 of the burner pipe 24 may easily reach the flames and a substantially complete combustion of the gases is realized.

Also in the round embodiment of the gas burner according to the invention shown in FIGS. 7A and 7B secondary air has an easy access to the flames. In this embodiment the ribbons 31 are of annular shape. At the inner and outer circumference said ribbons are provided with spacing means 32 and 33, the spacing means 33 at the inner circumference being staggered by half a pitch relative to the spacing means 32 at the outer circumference. Said annular ribbons 1 are clamped between an upper burner chamber 34 and a lower burner chamber 35. A mixture of gas and air is supplied to said burner chamber 34, 35 via a conduit 36 connected to the lower burner chamber 35.

It will be obvious that the invention is not restricted to the afore-described embodiments but that numerous modifications are possible which, however, are all within the scope of the invention.

I claim:

1. A gas burner comprising a mixing chamber with a burner mouth, in which a removable burner head is incorporated comprising a packet of strips, the strips of which in both longitudinal edge areas are provided with a row of spacing means, said strips being pressed against each other by wall faces of said burner mouth and being collected so as to form in said packet of strips one or more rows of slot shaped main gas burner ports between successive spacing means and one or more rows of auxiliary gas burner ports, characterized in that the rows of said spacing means in both the longitudinal edge areas of said strips are shifted by half a pitch relative to each other.

2. A gas burner according to claim 1, characterized in that the spacing means, viewed on the flat sides of the strip, are approximately semi-circular, the diameter of the semi-circle being situated approximately at the level of the strip edge.

3. A gas burner according to claim 1, in which the spacing means are obtained by deformation from one side at each of the edges of the strips up to a thickness dimension equal to approximately half the width of the main gas burner ports and said main gas burner ports are formed by two strips with their spacing means abutting against one another, characterized in that on one side or either side beside a row of main gas burner ports one or more rows of auxiliary gas burner ports are formed by arranging the strips with their spacing means in the recess of spacing means of the adjacent strips.

4. A gas burner according to claim 1, characterized in that the main gas burner ports of a row of said ports are shifted by part of the pitch relative to the main gas burner ports of an adjacent row.

5. A gas burner according to claim 1, characterized in that it comprises two burner mouths pointing aslant upwards and in opposite directions.

6. a gas burner according to claim 1, characterized in that the burner is substantially horizontally disc-like having along the periphery radial ports formed by ring-like flat strips with spacing means at the inner and outer edge areas shifted by half a pitch with respect to each other.

7. A gas burner comprising a mixing chamber with a burner mouth in which a removable burner head is incorporated comprising a packet of strips, the strips of which in at least one of the edge areas are provided with spacing means, said strips being pressed against each other by wall faces of said burner mouth and being collected so as to form in said packet of strips one or more rows of slot shaped main gas burner ports between successive spacing means and one or more rows of auxiliary gas burner ports, characterized in that of the rows of said spacing means defining the main gas burner ports in the gas burner, there being a row of said spacing means facing the gas supply side in said at least one of the edge areas and a row of said spacing means in at least one of the edge areas facing the flame side, the spacing means on the gas supply side being shifted by half a pitch relative to the spacing means facing the flame side.

8. Strips for forming a gas burner head for incorporation in a gas burner mouth comprising strips of which in at least one of the edge areas there are provided spacing means, said strips pressing against each other so as to form in said strips one or more rows of slot shaped main gas burner ports between successive spacing means and one or more rows of auxiliary gas burner ports, characterized in that of the rows of said spacing means defining the main gas burner ports, there being a row of said spacing means facing one side in said at least one of the edge areas and a row of said spacing means in at least one of the edge areas facing the other side, the spacing means on said one side being shifted by half a pitch relative to the spacing means facing said other side.

* * * * *